US006616069B1

(12) United States Patent
Jou

(10) Patent No.: US 6,616,069 B1
(45) Date of Patent: Sep. 9, 2003

(54) MULTIFUNCTION BLOW AND AIRLESS SPRAY GUN

(76) Inventor: Wuu-Cheau Jou, No. 497-6, Tsao Hu Road, Da Li City, Taichung Hsien (TW)

( * ) Notice: Subject to any disclaimer, the term of this patent is extended or adjusted under 35 U.S.C. 154(b) by 0 days.

(21) Appl. No.: 10/061,253

(22) Filed: Feb. 4, 2002

(51) Int. Cl.[7] ..... B05B 7/02

(52) U.S. Cl. ..... 239/525; 239/526; 239/532; 239/DIG. 21; 239/DIG. 22

(58) Field of Search ..... 239/525, 526, 239/532, DIG. 21, DIG. 22

(56) References Cited

U.S. PATENT DOCUMENTS 5,765,758 A * 6/1998 Chu ..... 239/526
5,832,974 A * 11/1998 Jou ..... 239/291
6,003,787 A * 12/1999 Fisher ..... 239/526
6,142,387 A * 11/2000 Jou ..... 239/525
6,145,161 A * 11/2000 Jou ..... 239/391

* cited by examiner

*Primary Examiner*—Robin O. Evans
(74) *Attorney, Agent, or Firm*—Charles E. Baxley

(57) ABSTRACT

In a convertible blow and airless spray gun, separate attachments may be substituted at the end of a blowpipe coupled to a blowgun by means of a connection thread formed on the tip end of the blowpipe. The blowgun can be secured to a long extension blowpipe or to an airless spray adaptor to construct an airless spray cleaning or painting gun. By means of the suction generated by the high speed compressed air flow in an attached hose, liquid in a tank is sucked up to mix with the high speed air jet stream at the inside of a blow head to force an atomized cleaner or paint jet stream to blow out. A nozzle carrier rotates freely to allow the attached hose to hang beneath the air gun body, so as to provide for ease of operation of the gun.

3 Claims, 9 Drawing Sheets

MULTIFUNCTION BLOW AND AIRLESS SPRAY GUN

BACKGROUND OF THE INVENTION

1. Field of the Invention

The present invention relates to a multifunction air-tool, and more particularly to a combined convertible blow and airless spray gun., which can be combined into multiple mechanisms for suiting to different purpose in application and improving good's market competence.

2. Description of Prior Art

In accordance with the conventional air blowgun 10 with a 4-inche standard length blowpipe, as shown in FIG. 1, it just only has a single function—blowing dust. But if meeting to a narrow or small space of the working site, the operator is unable to stretch the hand to reach the working area, so a different sized blowgun 20 with a longer blowpipe has to be need, as shown in FIG. 2. But in the industrial application, long and short blowguns are needed simultaneously for alternating use frequently. So said blowguns just only have a single function—blowing dust without any change in application, and the length of said blowpipe can not be changed, but simultaneous carrying both of them for meeting to the necessary of applying on various working sites will increase the cost.

In the other hand, the conventional dual spray gun for painting and cleaning is also designed with a single professional function. Although by taking the advantage of compressed air, as same as said blowguns, to generate sucking force in the sucking cable for sucking up the paint or cleaner and spraying out the mixed atomized paint or cleaner on the work piece, but they can not be manufactured in compatible structure for sharing a single set, so that the users have to buy them respectively.

OBJECTS AND SUMMARY OF THE INVENTION

It is therefore a main object of the present invention to provide a multifinction blow and airless spray gun, which integrate a kit of compatible long and short blowpipes and combined painting and cleaning functions into one set facilitating carryover and operation.

DETAILED DESCRIPTION OF PREFERRED EMBODIMENTS

Figure 1:
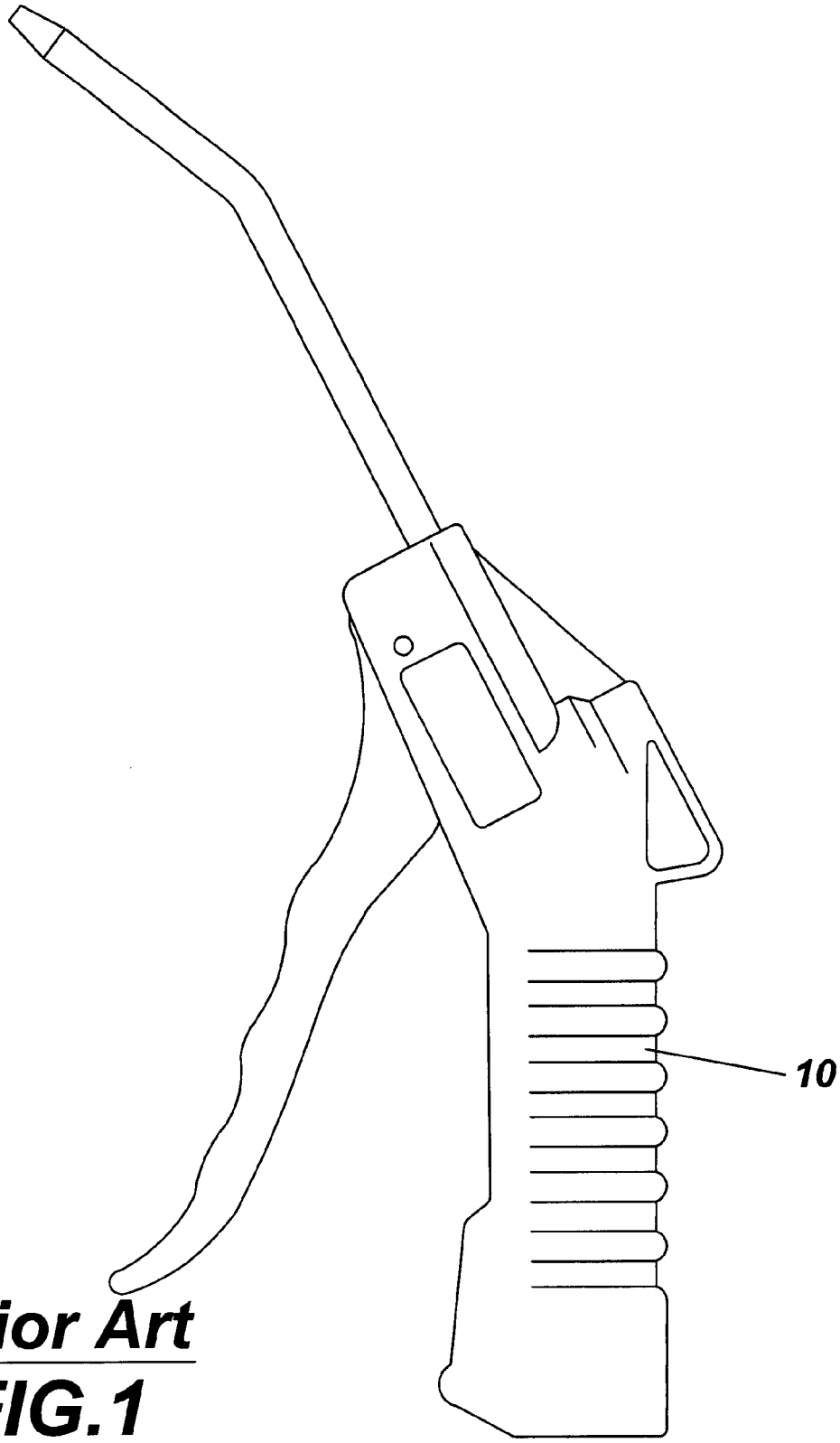
Prior Art FIG.1
FIG. 1 is a side view showing a conventional short blowgun.
Figure 2:
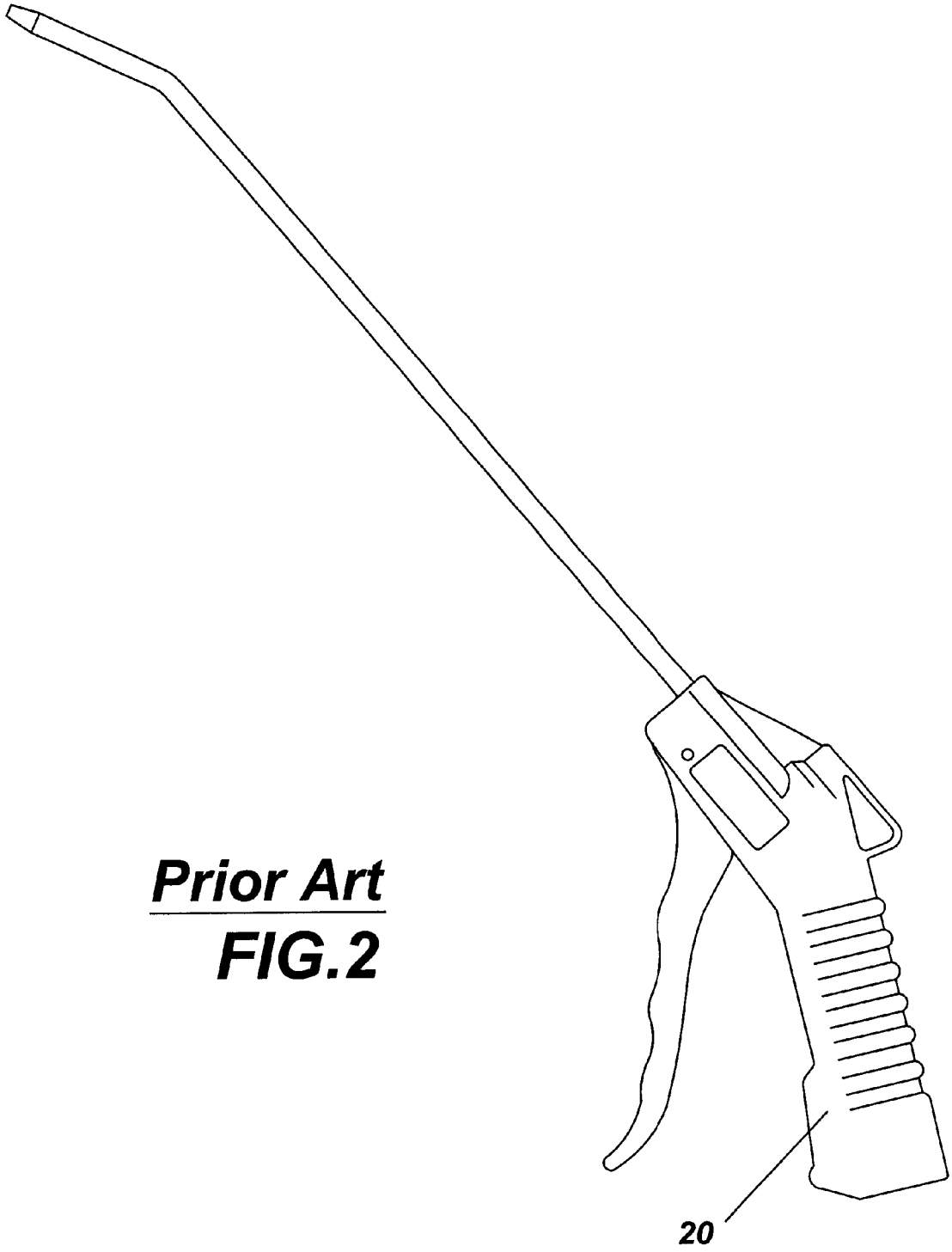
Prior Art FIG.2
FIG. 2 is a side view of a conventional long blowgun.
Figure 3:
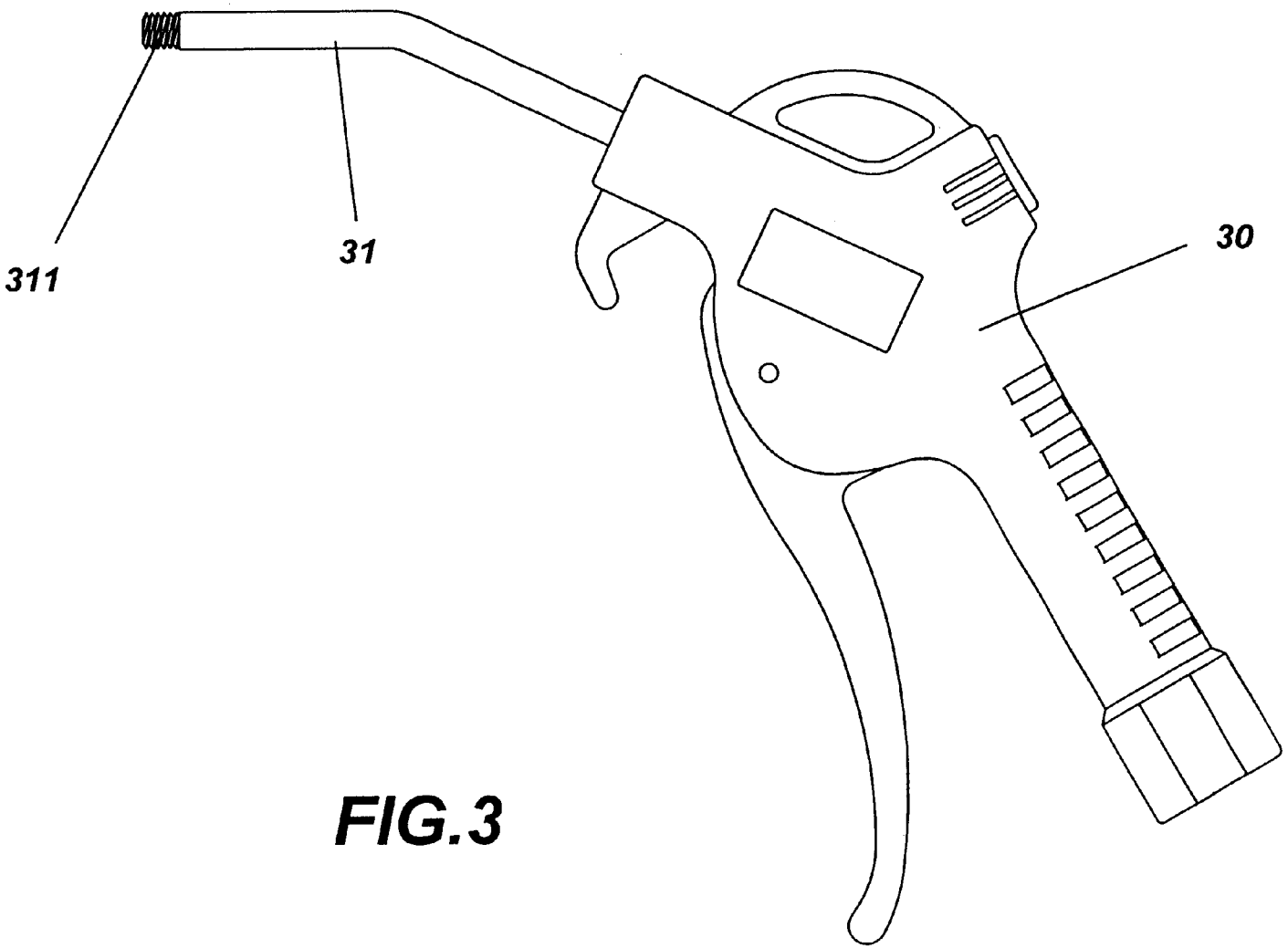
FIG. 3 is side view showing the using as a blowgun of the present invention.

Refering to FIG. 3, the present invention provides an air blowgun 30 comprising of a connecting thread 311 at the tip of a blowpipe 31 for connecting a different function adaptor to derive a different function air-tool.

Figure 5:
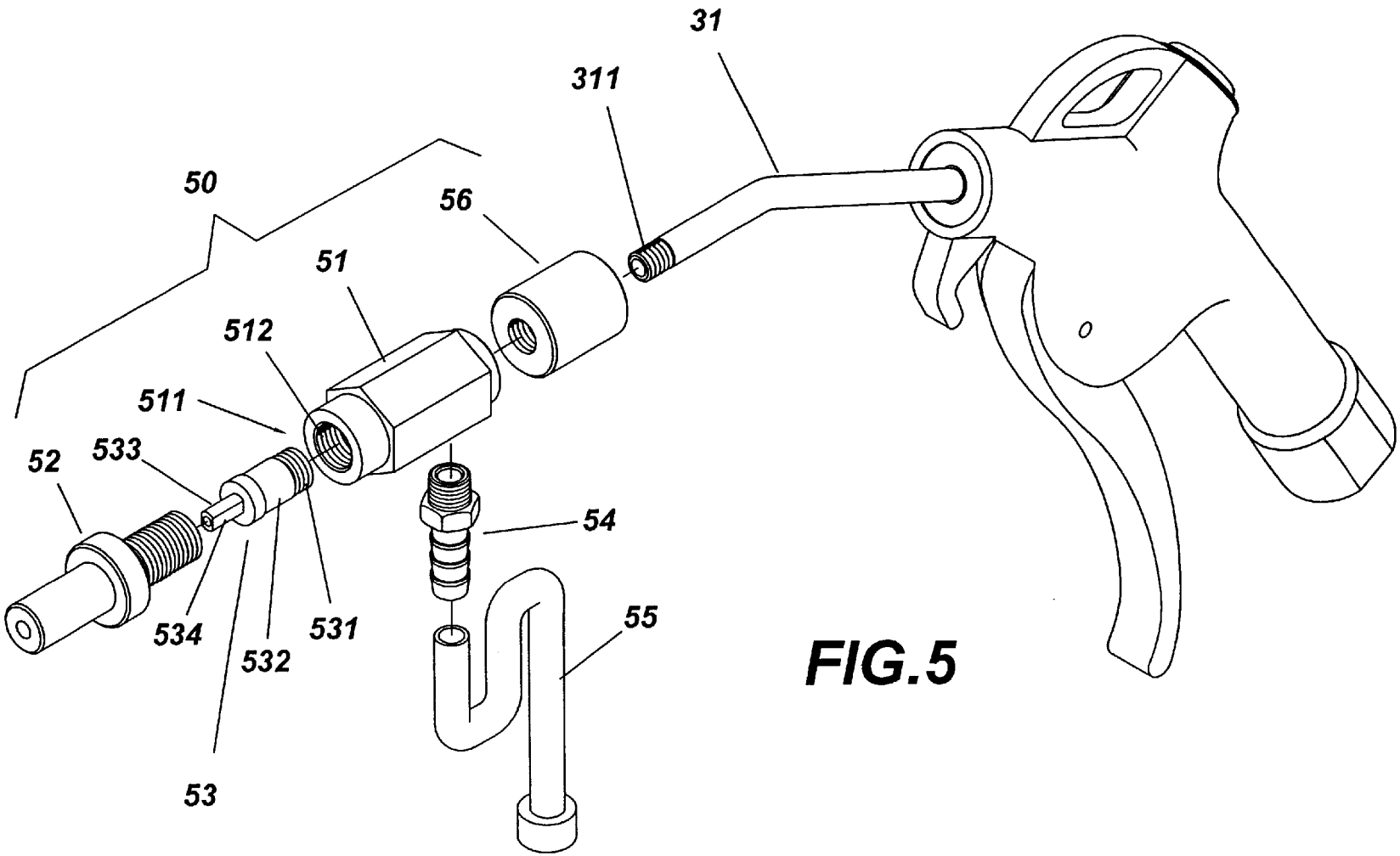
FIG. 5 is an exploded view showing attaching with a combined airless spray adaptor of the present invention.
Figure 6:
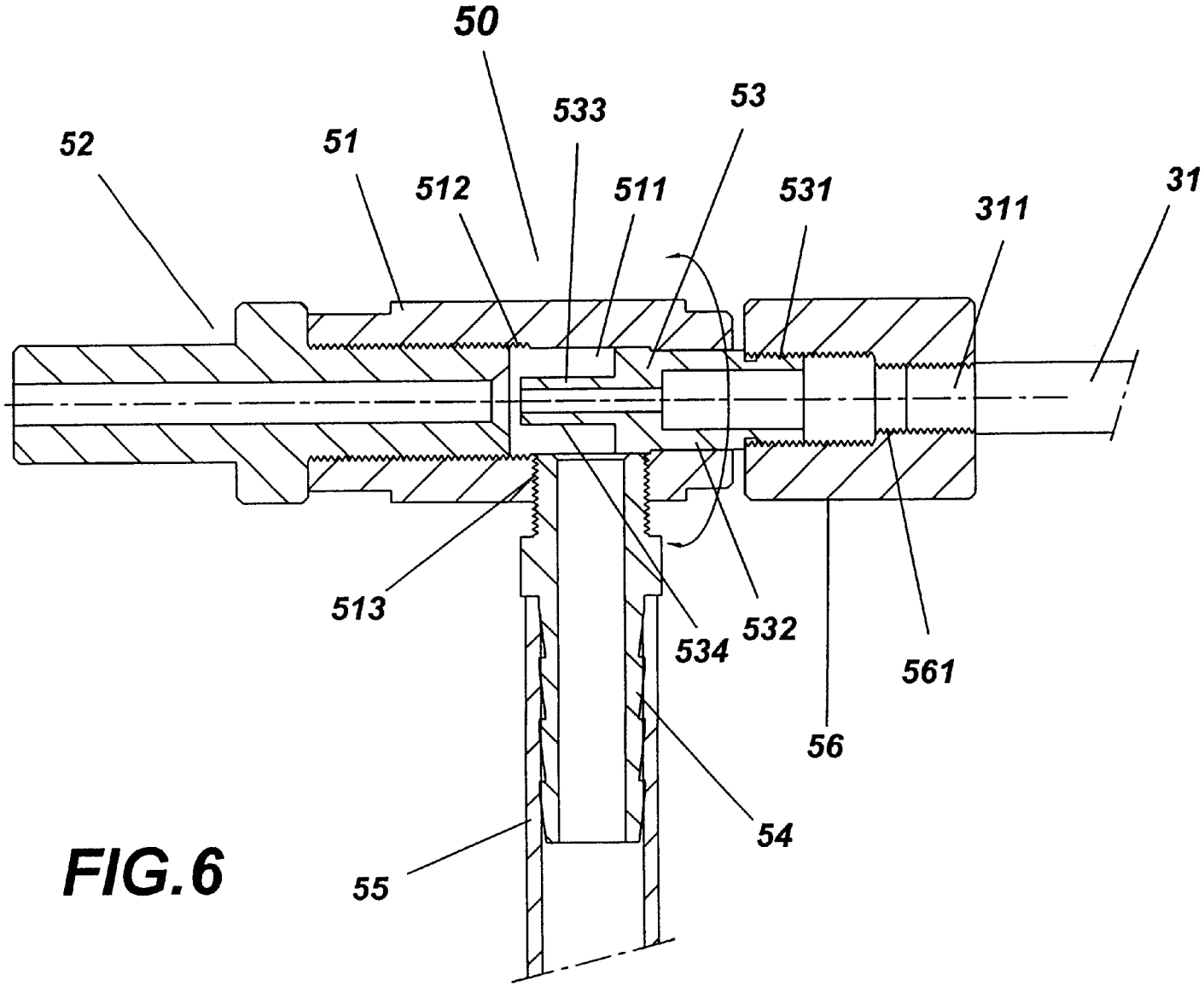
FIG. 6 is a cross-section view showing securing state of a combined airless spray adaptor of the present invention.

Referring to FIG. 5 and FIG. 6, an airless spray adaptor 50 of the present invention is comprised of a nozzle carrier 51 having a stepped hole 511, which has an internal screw 512 built on the bigger diameter end for securing the blow head 52, and an internal nozzle 53 contained in said stepped hole 511 so that the front tip of said internal nozzle 53 is kept a space with the back end of said blow head 52 in combination, and a downward through tap hole 513 built on the proper position of the bottom side for securing a cable connection 54 holding a cable 55; said internal nozzle 53 has an external screw 531 built on the back end stretching out from the back end of said nozzle carrier 51 for securing one end of a connecting nut 56 located on the back surface of a stopper 532 of said internal nozzle 53 so as to make said internal nozzle 53 have a free gap for rotating relatively, by means of said back surface of the stopper is extended out from the back side of said nozzle carrier 51 in combination, and the back end of said connecting nut 56 is secured on the tip end of said blowpipe 31 by joining the internal screw 561 and the external screw 311.

Figure 7:
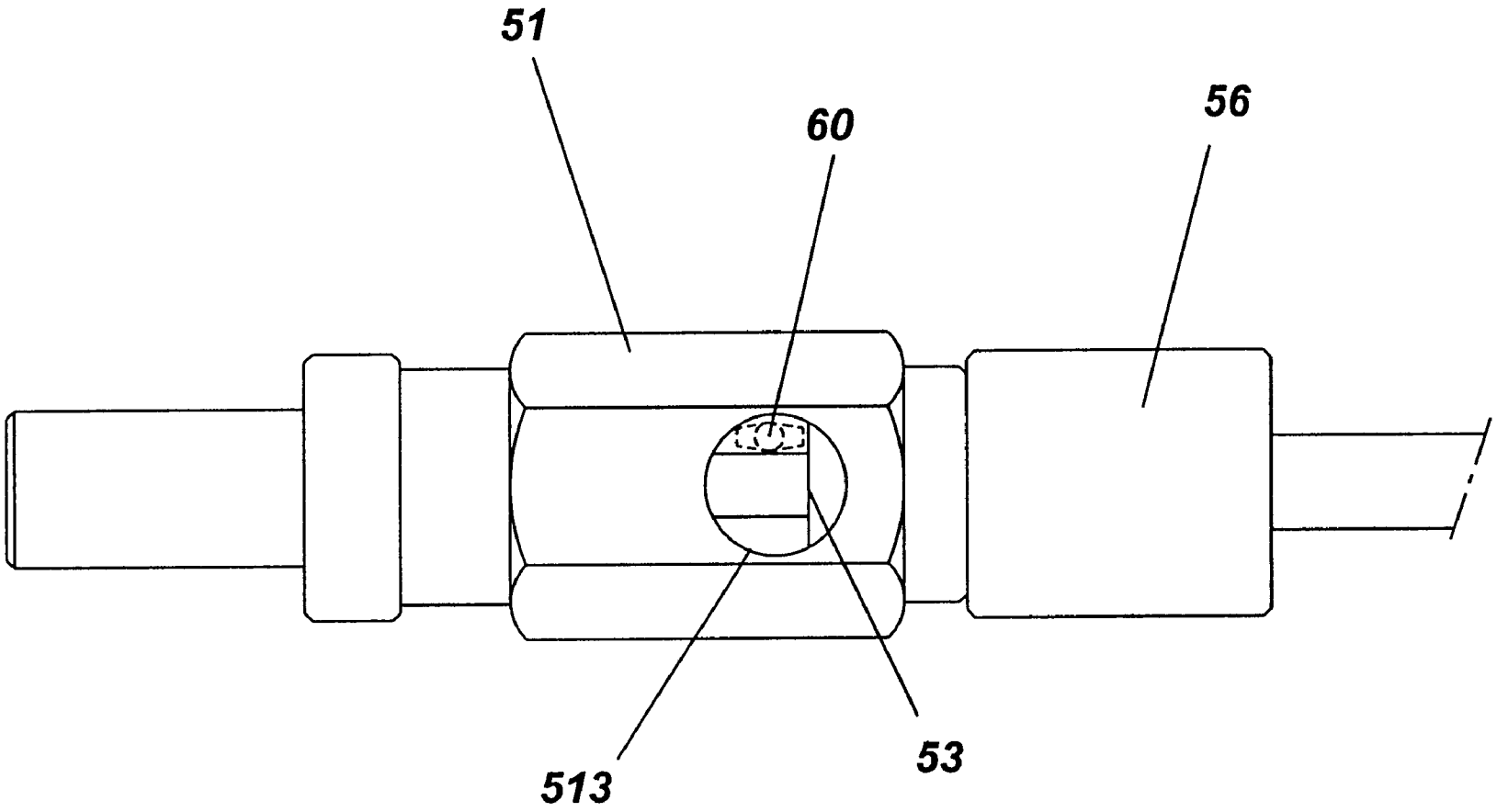
FIG. 7 is a bottom side view showing the bottom side of the secured the combined airless spray adaptor of the present invention.

Said internal nozzle 53 extends an injector spray tip 533 at the front side, which has a flat surface 534 at least for stropping it turning by plugging in screwdriver 60 or other fine bar from the tap hole 513 at the bottom side of said nozzle carrier 51 as securing said connecting nut 56 on, as shown in FIG. 7, so that said nozzle carrier 51 can be moved in a bit freely.

Figure 4:
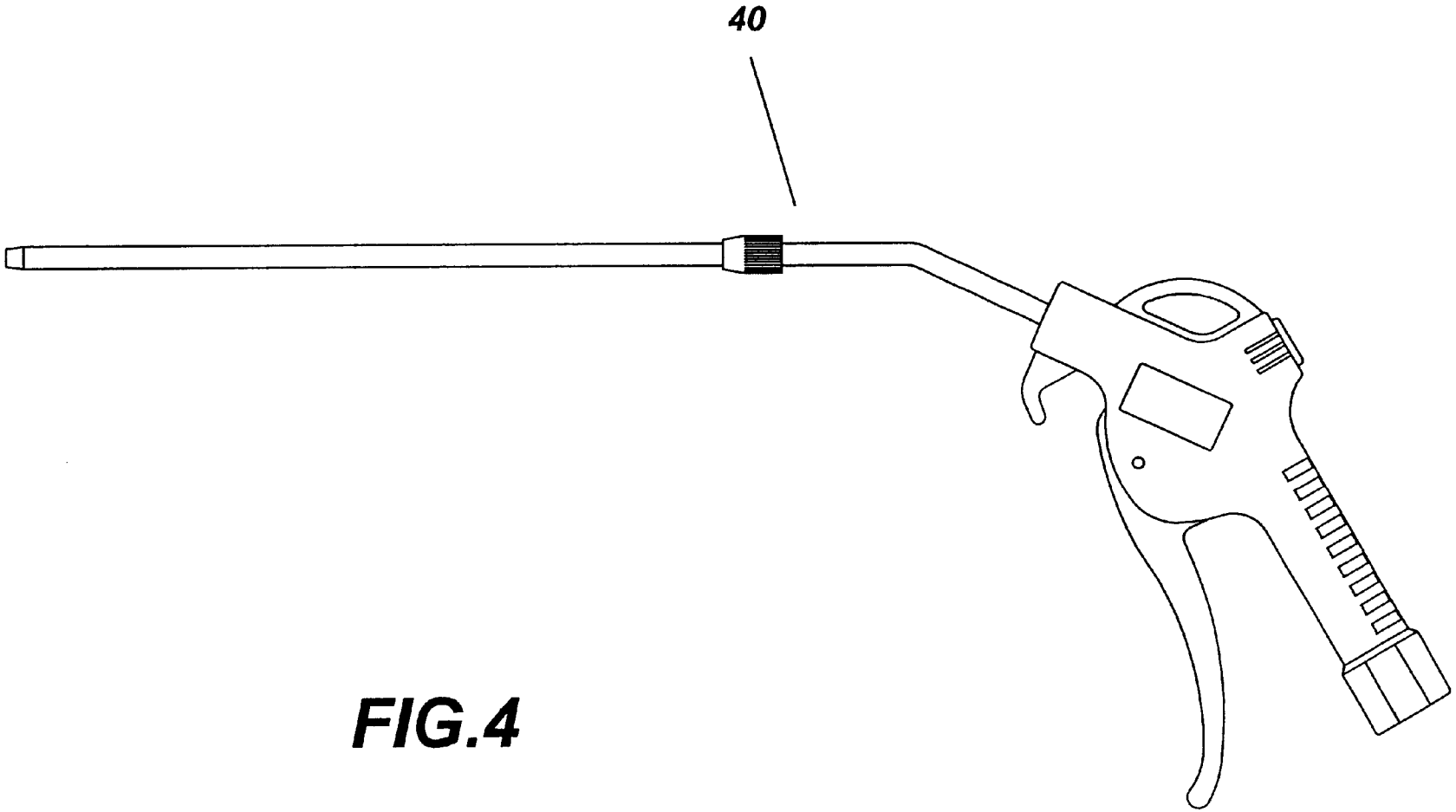
FIG. 4 is a side view showing the use combined a long blowpipe on the blowgun of the present invention.

According to above-described, the present invention can be derived into different function air-tool for meeting to the necessaries of production, the detail in practice is described in following:

§ Long and Short Blowgun Conversion Function:

Referring to FIG. 4, securing an extending blowpipe 40 on the tip end of the blowgun 31 of the original short blowgun 30 is carried out said long blowgun conversion function for be used in narrow and deep space or hard touching place blocked by obstacles, and is converted so easily and simply. On the other hand, an extending blowpipe 50 is in convenience of carryover without the bother of carrying two conventional blowguns—long and short blowguns.

Figure 8:
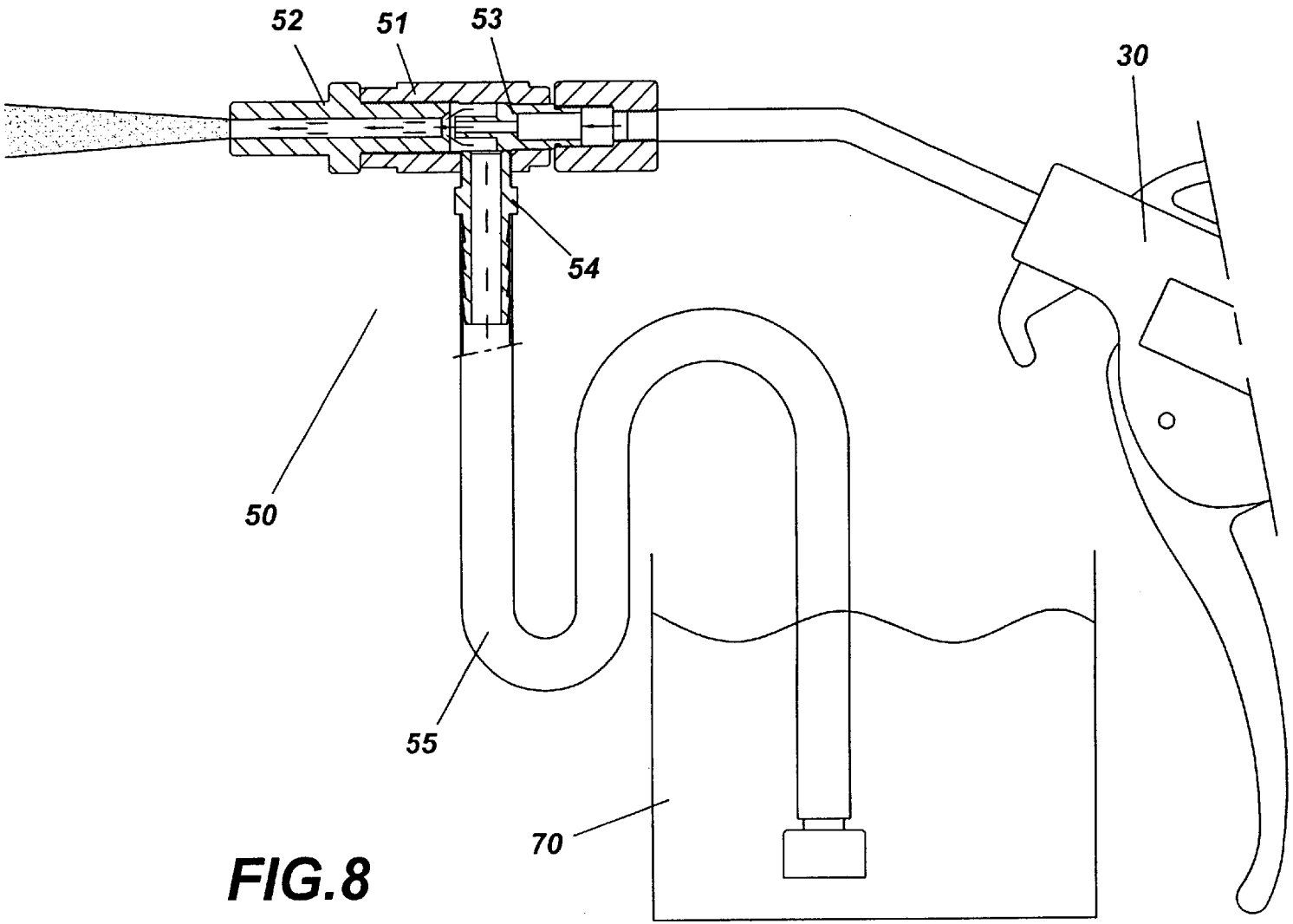
FIG. 8 is a scheme showing assembled spray gun with the combined airless spray adaptor of the present invention.

§ Cleaning Airless Spray Gun Function:

Referring to FIG. 8, it is showing an embodiment of use as an airless spray gun by attaching an airless spray adaptor 50 on the tip end of said blowpipe of said blowgun, meanwhile the cable 55 connected on said airless spray adaptor 50 by said cable connection 54 stretches the free end into a cleaner tank 70 directly, so that when press back the trigger of said blowgun 30 to cut in the valve to let the compressed air enter the inside of said airless spray adaptor 50 and blow out from the internal nozzle 53 in high speed to generate a negative pressure in the space of the inside of said nozzle carrier 51 simultaneously, said negative pressure creates a sucking force in said cable 55 to suck up the cleaner contained in the cleaner tank 70 through said cable 55 to mix with the high speed air jet stream at the inside of said blow head 52 to compound an atomized cleaner jet stream, further to generate high efficient cleaning function as a high efficient cleaning airless spray gun.

Figure 9:
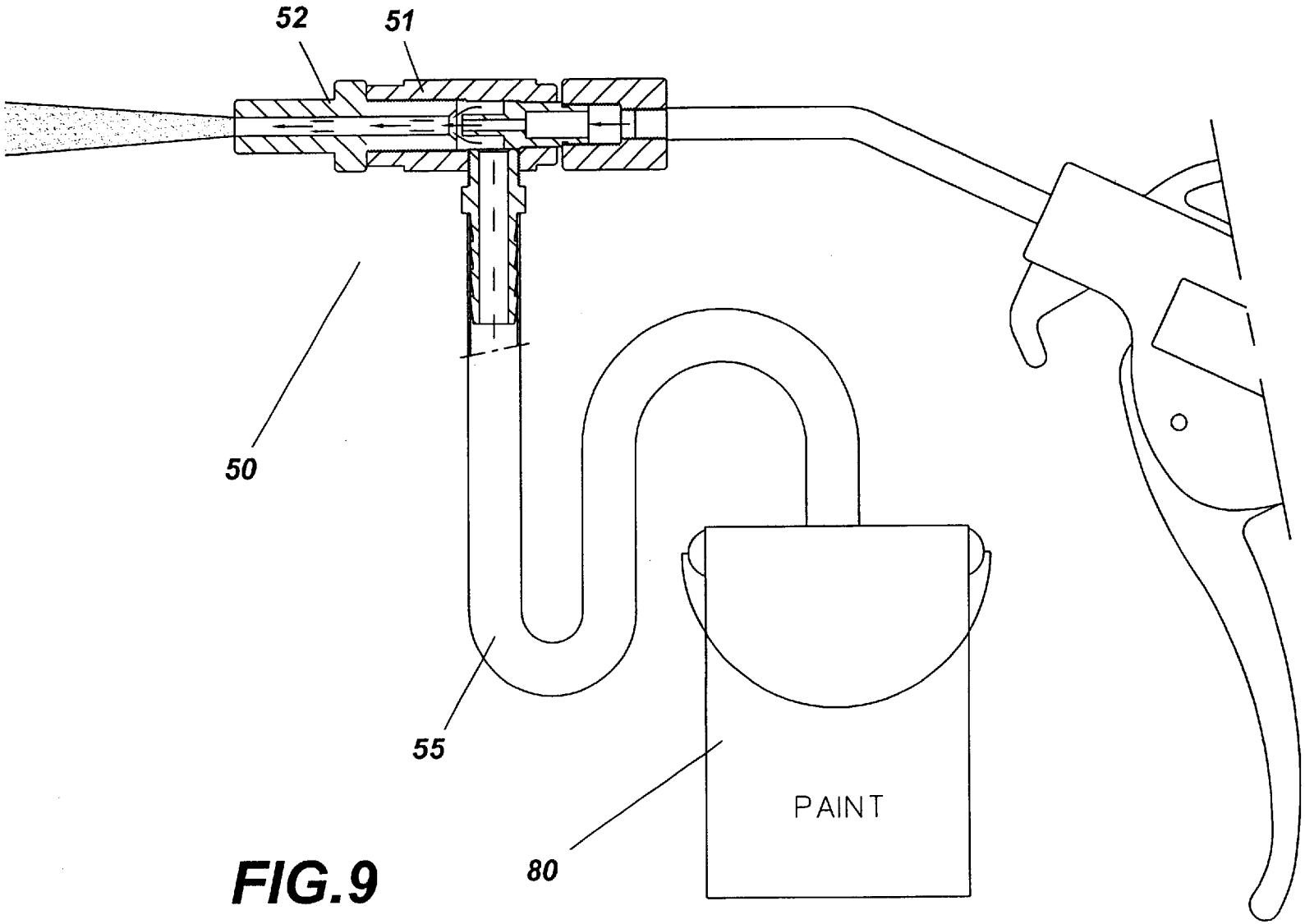
FIG. 9 is a scheme showing the use state as an airless spray gun of the present invention.

§ Base Paint Airless Spray Gun Function:

Referring to FIG. 9, based on the same principle of said cleaning airless spray gun, a painting airless spray gun just only replace the cleaner tank 70 in said cleaning airless spray gun application with a paint tank 80 so that the sucked liquid in the cable 55 is paint instead of the cleaner, to mix with the high speed air jet stream at the inside of said blow head 52 to compound an atomized paint jet stream, further to generate high efficient painting function as a high efficient painting airless spray gun for get the goal of changing multifunction effect.

§ Rotatable Airless Spray Adaptor Function:

Referring to FIG. 6, by means of the internal nozzle 53, said nozzle carrier 51 is connected to the connecting nut 56 without touching or securing, but the connecting nut 56 is located on the back surface of a stopper 532 of said internal nozzle 53 so as to make said internal nozzle 53 have a free gap from said nozzle carrier 51 for moving relatively—when the another end of said connecting nut 56 is secured on the tip of said blowgun, the nozzle carrier 51 can free rotate in any angle in round 360° to the benefit of said cable 55 connected on the bottom side of said nozzle carrier 51. When the user operates the cleaning or painting airless spray gun, the gun will be moved along with changing the working point or angle, but the longer cable 55 will be curled over relative to the fixed point—the end stretched in the inside of the tank 70 or 80, so as to block or to affect the operator's action of swinging process if the nozzle carrier 51 is fixed in still, so far this demerits is overcome by the rotational nozzle carrier 51, which can be spun an angle by the drive or dragging of said cable 55 to facility the operation.

In accordance with above-described, the present invention has following advanced progresses:

1. Combined multiple functions into one set, besides having all the functions of a conventional blowgun, but also by means of the connecting thread at the tip end of the blowpipe, it can be connected with variety nozzle adaptors to convert into a long blowgun with a long blowpipe, or an airless spray cleaning and painting gun with a nozzle adaptor for meeting to different necessaries in different working sites and purposes.
2. Facility to convert between the multiple functions, combining and replacing rapidly and conveniently make the carryover and maintenance easy and convenient, when a component is damaged or wore out, just need to replace one without buy a new whole gun set, so it is very economic for the users.
3. By means of the free rotational nozzle carrier, the cable will not block or affect the operator's action of swinging process whatever attitude and angle of holding the gun, further to improve the working efficient of the user, and facilitating the operation.

In summary, the present invention has thoroughly overcome the demerits of the above-mentioned prior arts in design, and combined multiple functions in the same principle into one set, further to improve the practicality of the air-tool production, and the space of development of commercial and capability of competition. It is suitable whatever to the various factories and family's DIYers.

I claim:

1. A multifunction blow and spray gun comprising:

a blowgun having a blowpipe coupled thereto, said blowpipe having a threaded portion at a distal end thereof for threadably coupling to either one of an extension tube or an airless spray adaptor, said airless spray adaptor including (a) a connecting nut for threadably engaging said distal end of said blowpipe;

(b) a nozzle carrier having formed therein a stepped bore composed of a first bore section having a first diameter and a second bore section having a second diameter, said first diameter being larger than said second diameter and having formed thereon a threaded portion, said nozzle carrier further having a downward through hole laterally formed in a longitudinal wall thereof, said downward through hole being in communication with said stepped bore and threaded on inner walls thereof;

(c) an internal nozzle including a stopper and an injector spray tip, said stopper including a first stopper section having a first diameter substantially equal to but not greater than said first diameter of said stepped bore of said nozzle carrier, and a second stopper section having a second diameter substantially equal to but not greater than said second diameter of said stopped bore of said nozzle carrier, said second stopper section having formed thereon threads at an end thereof, said injector spray tip longitudinally extending from said stopper section and including at least one flat surface on an exterior wall thereof, said injector nozzle having formed therethrough an axial bore having a first diameter at a distal end of said injector spray tip and a second diameter at said threaded end of said stopper, wherein said internal nozzle is inserted into said stepped bore of said nozzle carrier so that said threaded end of said stopper extends therethrough and is threadedly engaged with said connecting nut such that said axial bore of said injector nozzle is axially aligned with said blowpipe;

(d) a blow head having formed therethrough an axial bore, said blow head including a threaded section at one end thereof for threadably coupling to said nozzle carrier such that said end having said threaded section is removed from said distal end of said injector spray tip by a predetermined distance and said axial bore is aligned with said axial bore of said internal nozzle; and (e) a hose connector threadedly coupled to said downward through hole of said nozzle carrier for connecting to a hose; and said extension tube having formed at one end thereof threads for threadably connecting to said distal end of said blowpipe.

2. The multifunction blow and spray gun as recited in claim 1, wherein said axial bore of said internal nozzle is step-wise reduced from said second diameter to said first diameter.

3. The multifunction blow and spray gun as recited in claim 2, wherein said axial bore is reduced from said second diameter to said first diameter in a single step.

* * * * *